US005337548A

United States Patent [19]

Kelly

[11] Patent Number: 5,337,548

[45] Date of Patent: Aug. 16, 1994

[54] METHOD AND APPARATUS FOR SPLICING ROPE

[76] Inventor: Phillip R. Kelly, Rte. 3, Box 105C, Jonesboro, La. 71251

[21] Appl. No.: 849,571

[22] Filed: Mar. 11, 1992

[51] Int. Cl.[5] ..... B23P 19/02; D01H 17/00

[52] U.S. Cl. ..... 57/23; 29/235; 57/22; 174/93

[58] Field of Search ..... 57/22, 23, 295; 156/311, 502; 174/93; 29/235

[56] References Cited

U.S. PATENT DOCUMENTS

| | | | |
|---|---|---|---|
| 1,503,688 | 8/1924 | Pearson et al. | 57/22 |
| 1,521,906 | 1/1925 | Rohr | 57/22 |
| 1,895,828 | 1/1933 | Inwagen | 57/22 |
| 2,038,840 | 4/1936 | Hall | 29/88.2 |
| 2,703,300 | 3/1955 | Koon | 57/22 X |
| 2,840,896 | 7/1958 | Edwards | 29/450 |
| 2,943,434 | 7/1960 | Joy et al. | 57/22 X |
| 3,675,407 | 7/1972 | LaRue | 57/22 |
| 3,824,331 | 7/1974 | Mixon et al. | 174/135 |
| 3,946,480 | 3/1976 | Dienes | 29/235 |
| 4,214,431 | 7/1980 | Bruce et al. | 57/22 |
| 4,573,251 | 3/1986 | Hillyard | 29/235 X |
| 5,039,373 | 8/1991 | Gilhaus | 57/23 |

*Primary Examiner*—Daniel P. Stodola
*Assistant Examiner*—William Stryjewski
*Attorney, Agent, or Firm*—John M. Harrison

[57] ABSTRACT

A splicing apparatus and method for splicing rope, which apparatus includes a wheeled frame fitted with a splicing plate having upward-standing, spaced rope clamps for receiving and clamping rope segments to be spliced. In a preferred embodiment, a vise is also mounted on the splicing plate for removably receiving a dowel clamp which clamps one end of a dowel on the splicing plate, with the other end of the dowel supported by a cylindrical dowel keeper. A dowel is stabilized in the dowel clamp and dowel keeper and is designed to receive a length of rubber sleeve. The dowel keeper further receives a plastic cylinder or transfer tube inserted on one end of the dowel through the dowel keeper, adjacent to the rubber sleeve to facilitate rolling the rubber sleeve on the transfer tube as a rubber "donut" sleeve. The transfer tube and "donut" sleeve are then removed from the dowel and placed in one of the rope clamps to receive one of the rope segments, after which the rope segments are spliced by hand, glue is applied to the splice, the rubber donut sleeve is rolled from the transfer tube to cover the splice as a sheath and the transfer tube is cut from the spliced rope.

6 Claims, 2 Drawing Sheets

FIG. 1
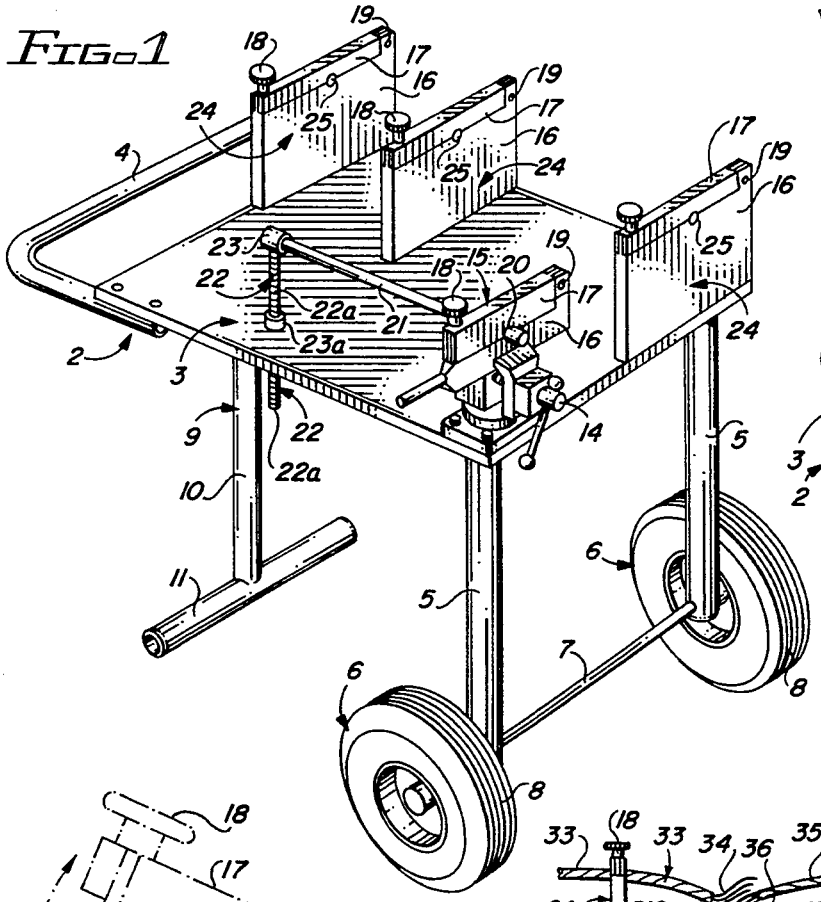
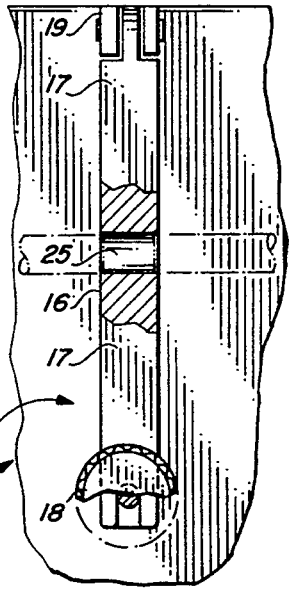
FIG. 3
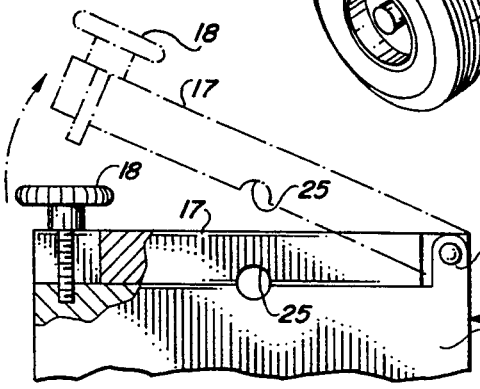
FIG. 2
FIG. 5
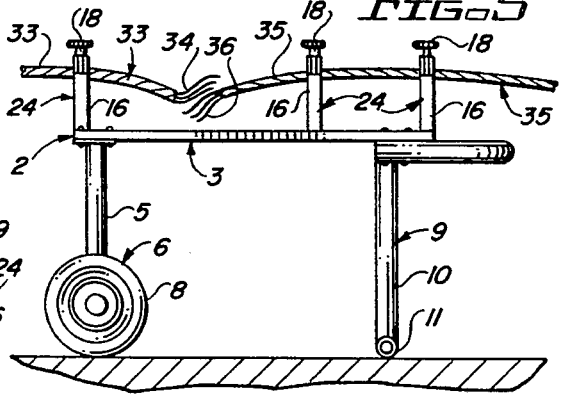
FIG. 4
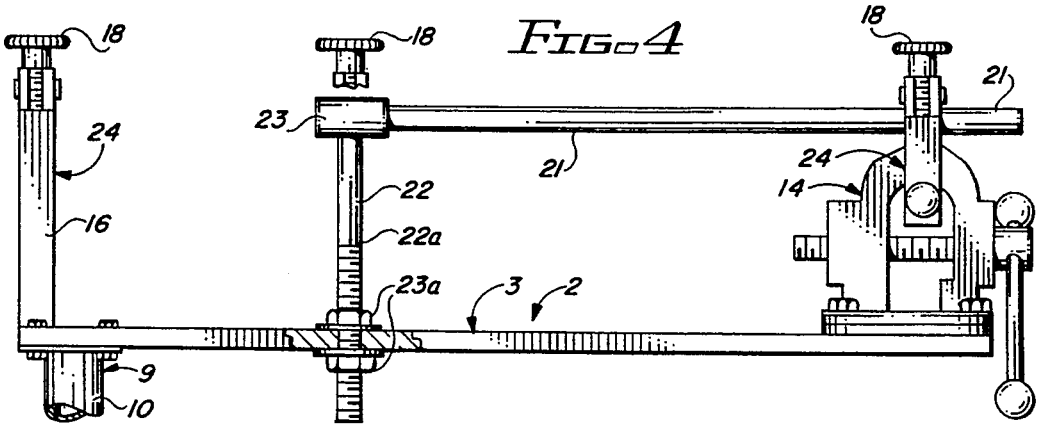

SPLICE
SPLICE
SPLICE

METHOD AND APPARATUS FOR SPLICING ROPE

BACKGROUND OF THE INVENTION

1. Field of the Invention

This invention relates to splicing apparatus and techniques for Splicing rope such as hemp, sisal and nylon and more particularly, to a splicing apparatus and method for covering a nylon rope splice with a rubber sheath to minimize wear in the area of the splice.

One of the problems which is realized in the use of ropes which have been spliced is the rapid wearing of the rope at the spliced area, since the splice is slightly larger than the rope itself. Accordingly, movement of the rope through pulleys, sheaves and similar working apparatus causes the splice to wear more rapidly than the non-spliced areas of the rope because of the additional pressure exerted on the splice. This problem is particularly troublesome in the paper manufacturing business where nylon ropes are extensively used in the paper-making process. Since the ropes must traverse numerous pulleys and other devices in the course of travel through the paper-making apparatus, considerable down-time and labor is realized when the ropes break and then break again at the spliced areas. It is cost-prohibitive to replace each rope without splicing, so the ropes must be periodically spliced at each break and rebreak, a procedure which is costly in terms of labor and lost production time.

2. Description of the Prior Art

Sisal, hemp and nylon ropes are typically spliced by hand, joining the severed segments in a weaving or plating operation. These splices are necessarily larger in diameter than the rope segments which have been spliced and traversal of the spliced areas through apparatus such as pulleys and sheaves causes excessive wear at the enlarged splices, thereby effecting frequent additional breaks at the spliced areas.

Accordingly, it is an object of this invention to provide a new and improved rope splicing apparatus and method for splicing rope such as sisal, hemp and nylon rope.

Another object of the invention is to provide a splicing apparatus for splicing nylon rope and covering the splice with a rubber sheath to protect the splice.

Yet another object of this invention is to provide a new and improved apparatus for supporting rope segments to be spliced and subsequently covering the splice with an adhesive and a rubber sheath to better facilitate movement of the splice through pulleys and other apparatus and prolonging the life of the splice during various industrial operations involving the spliced rope.

Still another object of this invention is to provide a splicing apparatus for supporting and positioning nylon rope segments to be spliced, which apparatus includes a wheeled frame fitted with three upward-standing, spaced rope clamps for clamping two segments of the nylon rope in facing relationship to be spliced and further including an apparatus for removably mounting a dowel to facilitate placement of a rubber sleeve on the dowel, rolling the rubber sleeve in "donut" fashion from the dowel to a plastic transfer tube and subsequently mounting the transfer tube in the middle rope clamp for receiving one of the rope segments, splicing the rope by hand, applying glue to the splice and rolling the donut-shaped rubber sleeve onto the splice as a sheath to protect the splice from wear.

A further object of this invention is to provide a method for splicing three-strand nylon rope and protecting the splice from wear, which method includes the steps of providing a splicing apparatus for supporting a pair of nylon rope segments to be spliced in splicing configuration, inserting a rubber sleeve on a dowel, inserting a plastic transfer tube on the dowel to the rubber sleeve, rolling the rubber sleeve in "donut" fashion from the dowel onto the transfer tube, mounting the transfer tube in a rope clamp to receive one of the rope segments to be spliced, splicing the rope by hand, applying glue to the splice, rolling the donut-shaped rubber sleeve from the transfer tube onto the splice to cover and protect the splice and removing the plastic transfer tube from the spliced rope.

SUMMARY OF THE INVENTION

These and other objects of the invention are provided in a splicing apparatus and method for splicing nylon rope and protecting the rope splice, which apparatus includes a wheeled frame provided with a flat splicing plate that receives three spaced, upward-standing rope clamps and a support apparatus for receiving a dowel, a plastic transfer tube adapted for fitting on one end of the dowel adjacent to a rubber sleeve slipped on the dowel and wherein the splicing method includes the steps of rolling the rubber sleeve from the dowel to the transfer tube in a "donut" configuration, removing the transfer tube and donut sleeve from the dowel support apparatus and placing it in the center rope clamp, extending one of the rope segments to be spliced through one of the outside rope clamps and the transfer tube, into splicing configuration with the opposite rope segment, which is secured by the other outside rope clamp, splicing the rope segments, placing glue on the splice, rolling the rubber sleeve from the donut configuration on the transfer tube into a sheath configuration over the glue on the splice and cutting or otherwise removing the plastic transfer tube from the spliced rope.

BRIEF DESCRIPTION OF THE DRAWING

The invention will be better understood by reference to the accompanying drawings, wherein:

FIGURE I is a perspective view of a preferred embodiment of the splicing apparatus of this invention;

FIG. 2 is a sectional view of a preferred rope clamp element of the splicing apparatus illustrated in FIG. 1;

FIG. 3 is a top view of the rope clamp elements illustrated in FIGS. 1 and 2;

FIG. 4 is a side view of the top segment of the splicing apparatus illustrated in FIG. 1;

FIG. 5 is a side view of the splicing apparatus illustrated in FIG. 1 with a pair of rope elements positioned in splicing configuration;

DESCRIPTION OF THE PREFERRED EMBODIMENTS

Figures 6A, 6B, 6C, 6D, 6E, 6F, 6G, 6H, 6I, 6J, 6K, 6L:
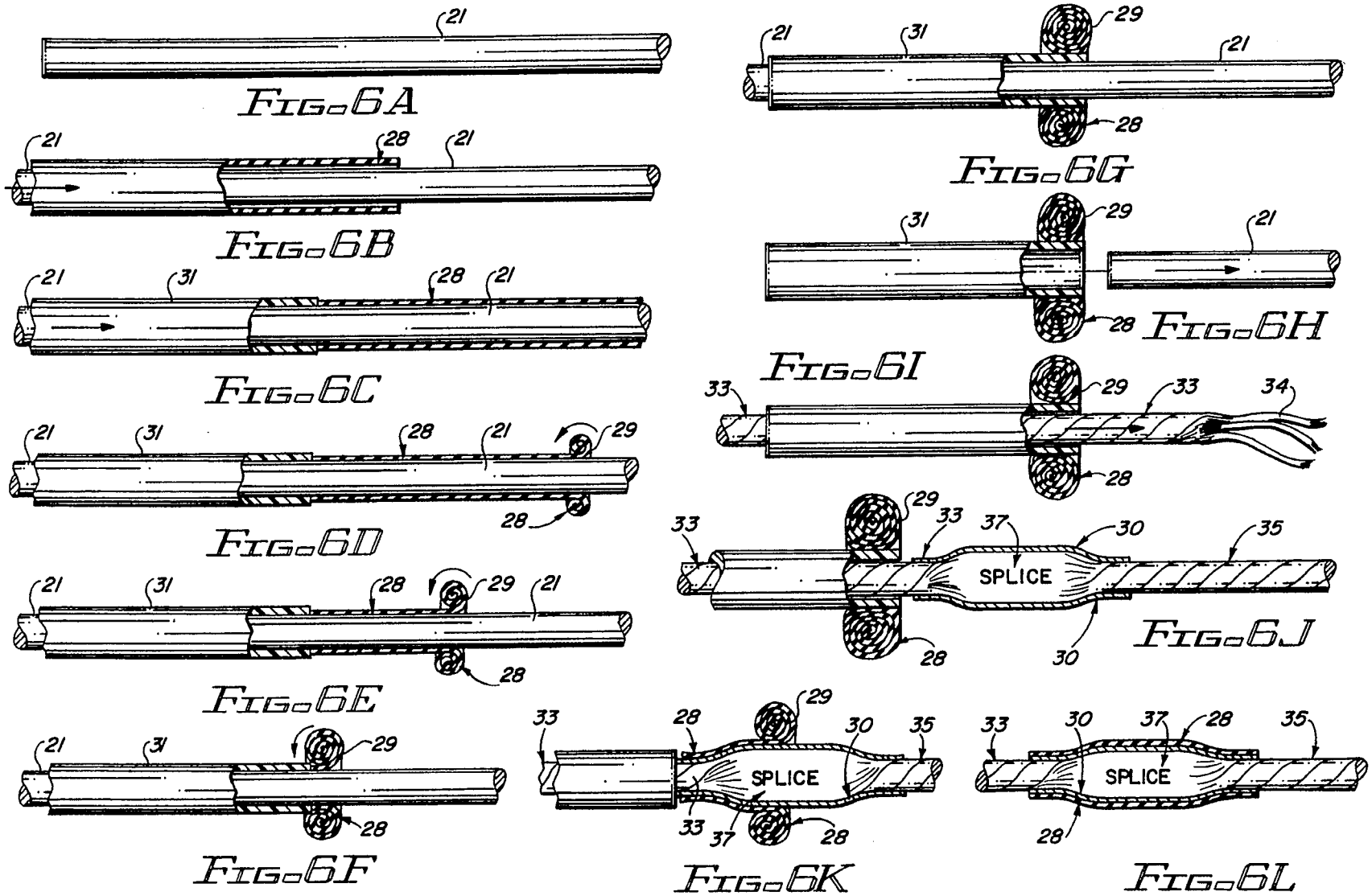
FIG. 6A is a side view of a dowel element in a preferred embodiment of the splicing apparatus of this invention.
FIG. 6B is a side sectional view of the dowel illustrated in FIG. 6A and a rubber sheath slipped over the dowel.
FIG. 6C is a side sectional view of the dowel and rubber sheath illustrated in FIG. 6B and a transfer tube fitted over one end of the dowel to the rubber sheath.
FIGS. 6D, 6E, 6F, 6G, and 6H are side sectional views of the dowel, rubber sheath and transfer tube, with the rubber sheath successively rolled from the dowel onto the transfer tube as a "donut"
FIG. 6I is a side sectional view of the transfer tube, "donut" sheath and a rope segment extended through the transfer tube.
FIG. 6J is a side sectional view of a rope splice with glue applied and oriented to receive the rubber sheath rolled on the transfer tube.
FIG. 6K is a side sectional view of the rubber sheath partially rolled from the transfer tube onto the completed splice.
FIG. 6L is a side sectional view of the splice with the rubber sheath in place.

Referring initially to FIGS. 1–4 of the drawings, the splicing apparatus of this invention is generally illustrated by reference numeral i and includes a frame 2, which includes a flat, horizontally disposed splicing plate 3, a handle 4, bolted to one end of the splicing plate 3 and a pair of spaced wheel legs 5 projecting downwardly from the bolted attachment to the splicing plate 3 for receiving a wheel axle 7, which mounts a pair of spaced wheels 6. The wheels 6 are preferably fitted with pneumatic tires 8 to facilitate ease of transportation while grasping the handle 4 and a T-support 9 extends downwardly from the splicing plate 3 in spaced relationship with respect to the wheel legs 5. The T-support 9 is characterized by a vertical leg 10 having one end bolted to the splicing plate 3 and the opposite end provided with a horizontal leg 11, mounted to the vertical leg 10 by means of leg bolts (not illustrated). A vise 14 is mounted on one end of the frame 2 and removably mounts a dowel clamp 15, which is characterized by a clamp base 16, fitted with a clamp top 17 and a clamp hinge 19, which hingedly mounts the clamp top 17 to the clamp base 16. A threaded clamp bolt 18 extends vertically through the clamp top 17 for removably securing the clamp top 17 tightly against the clamp base 16. A dowel opening 20 receives one end of a dowel 21 to removably clamp the dowel 21 in a horizontal position above the splicing plate 3, as illustrated in FIG. 1. The opposite end of the dowel 21 rests in the oversized keeper ring 23 of a dowel keeper 22, which keeper ring 23 is supported by a threaded bar **22*a*, adjustably secured by bar nuts 23*a*, which keeper ring 23 is larger in diameter than the diameter of the dowel 21. Three identical rope clamps 24 are located on the splicing plate 3 in spaced relationship opposite the dowel keeper 22 and dowel clamp 15 and are each provided with a clamp base 16, bolted the splicing plate 3, a clamp top 17 and a clamp hinge 19 for hingedly mounting the clamp top 17 on the clamp base 16 in the same manner as the dowel clamp 15. A rope opening 25 is provided in each clamp top 17 and clamp base 16 of the respective rope clamps 24 to receive a first rope segment 33 and a second rope segment 35, such that the first rope segment strands 34 of the first rope segment 33 and the second rope segment strands 36 of the second rope segment 35 to be spliced are located in facing relationship in a splicing zone 26 lying between the middle and end ones of the rope clamps 24. A 110 volt outlet 13 is provided for energizing a hot glue gun and applying the glue 30**.

Referring now to FIG. 1 and 4 of the drawings, it will be appreciated that the splicing apparatus 1 can be used to splice the two broken segments of a nylon rope by extending the first rope segment 33 and second rope segment 35 through respective rope openings 25 in corresponding rope clamps 24 and splicing the rope by hand in conventional fashion, according to the knowledge of those skilled in the art. Insertion of the first rope segment 33 and the second rope segment 35 in the rope openings 25 of the respective rope clamps 24 is easily accomplished by initially pivoting a corresponding clamp bolt 18 from the clamp base 16 on the respective clamp hinge 19, inserting the first rope segment 33 and second rope segment 35 in the corresponding rope opening 25, respectively, and re-pivoting the clamp bolt 18 and clamp base 16 in each case over the first rope segment 33 and second rope segment 35. The clamp bolts 18 can then be manipulated to secure the clamp bolts 18 on each clamp base 16. After the splice is completed, the spliced first rope segment 33 and second rope segment 35 are removed from the respective rope clamps 24 by reversing the clamp bolts 18 with respect to the clamp bases 16, respectively, and the spliced rope is removed. Accordingly, in a first preferred embodiment of the invention the first rope segment 33 and second rope segment 35 are immobilized in the facing rope clamps 24 as illustrated in FIG. 4 to facilitate splicing the facing first rope segment strands 34 and second rope segment strands 36 together. After the splice is completed, the spliced rope may be removed from the rope clamps 24.

In a most preferred embodiment of the invention, referring to FIGS. 1, 4 and 6A–6C, a plastic transfer tube 31 is designed such that the outside diameter of the transfer tube 31 fits inside the keeper ring 23 of the dowel keeper 22 and the inside diameter of the transfer tube 31 is slightly larger than the outside diameter of the dowel 21. Accordingly, the transfer tube 31 easily slips through the keeper ring 23 over one end of the dowel 21, as illustrated in FIG. 6B. A rubber sleeve 28 is designed to fit over the opposite end of the dowel 21 when the dowel 21 is removed from the rope clamp 24, mounted in the vise 14, and is typically about 12 inches in length, as illustrated in FIG. 6C. The rubber sleeve 28 is typically scavenged from a bicycle inner tube and serves as a sheath fitted over the dowel 21 in a loose fit to facilitate easy removal of the rubber sleeve 28 from the dowel 21, as hereinafter further described.

Referring now to FIGS. 6C–6L, the rubber sleeve 28 is typically slipped over one end of the dowel 21 responsive to pivoting of the clamp top 17 from the clamp base 16 of the corresponding dowel clamp 15. That end of the dowel 21 is then reinserted in the dowel clamp 15 by reversing the procedure described above. One end of the plastic transfer tube 31 is then inserted the keeper ring 23 of the dowel keeper 22 over the corresponding end of the dowel 21, to the edge of the rubber sleeve 28, as illustrated in FIG. 6C. The rubber sleeve 28 is then rolled from the dowel 21 onto the transfer tube 31 in successive rolled layers to define a sleeve donut 29, as illustrated in FIGS. 6D–6H. The clamp top 17 is then pivoted from the clamp base 16 of the dowel clamp 15 to free the opposite end of the dowel 21 and the dowel 21 is removed from the dowel clamp 15 and the dowel keeper 22 to facilitate removal of the transfer tube 31 and sleeve donut 29 from the keeper ring 23. The transfer tube 31 is then mounted in the center one of the rope clamps 24 by manipulating the corresponding clamp top 17 with respect to the clamp base 16, as described above. The transfer tube 31 is secured in the rope clamp 24 by tightening the clamp bolt 18, with the rubber sleeve 28 and sleeve donut 29 projecting into the splicing zone 26. The first rope segment 33 is then mounted in one of the end rope clamps 24 with sufficient slack for insertion through the transfer tube 31, such that the first rope segment strands 34 are located in the splicing zone 26, as illustrated in FIG. 6I. Similarly, the second rope segment 35 is inserted in the rope opening 25 of the corresponding and facing opposite rope clamp 24, with the second rope segment strands 36 facing the first rope segment strands 34 in the splicing zone 26. The first rope segment strands 34 and second rope segment strands 36 are then spliced by hand in conventional fashion as described above to define a splice 37 and secure the first rope segment 33 to the second rope segment 35. When the rope splice is complete, a layer of glue 30 is applied to the splice 37 created by joining the first rope segment strands 34 and second rope segment strands 36, as illustrated in FIG. 6J. The sleeve donut 29 of the rubber sleeve 28 is then rolled from the "donut" configuration on the end of the transfer tube 31 onto the splice 37, over the layer of glue 30 in sheath-fashion, as illustrated in FIGS. 6K and 6L, to completely cover the splice 37 and protect the splice 37 from wear when the rope is used. The plastic transfer tube 31 is then cut from the spliced rope by shears or removed by other techniques, according to the knowledge of those skilled in the art.

It will be recognized by those skilled in the art that the splicing apparatus 1 of this invention may be used both in portable and fixed mode, although only the preferred portable mode is illustrated in the drawings. The splicing apparatus I can be utilized to splice rope of various composition and optionally place a protective sheath on the rope, as described above. In its portable embodiment, the splicing apparatus I may be moved from one work location to the other to quickly, easily and efficiently splice rope segments and minimize costly down-time due to labor and idle equipment. In a most preferred embodiment of the invention the splicing apparatus 1 is constructed of aluminum components and is designed to splice nylon rope. However, the dowel may be wood and other wooden and/or metal or plastic components may be utilized, and rope such as sisal and hemp may also be spliced, according to the knowledge of those skilled in the art.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A splicing apparatus for supporting a pair of rope segments to be sliced, comprising a frame; a plurality of rope clamps carried by said frame in spaced relationship with respect to each other; a dowel support carried by said frame; a dowel removably carried by said dowel support; a resilient sleeve inserted on said dowel and a cylindrical transfer tube sized for fitting over said dowel to said resilient sleeve, whereby said resilient sleeve is rolled from said dowel onto said transfer tube, said transfer tube is clamped in an outside one of said rope clamps, one of the rope segments is extended through said transfer tube, wherein the rope segments are spliced, said resilient sleeve is rolled from said transfer tube over the splice and said transfer tube is removed from the spliced rope segments.

2. The splicing apparatus of claim 1 further comprising a splicing plate provided in said frame and wherein said rope clamp means and said dowel support means are mounted on said splicing plate.

3. The splicing apparatus of claim 1 wherein said dowel support means further comprises a vise carried by said splicing plate, a dowel clamp removably clamped in said vise for receiving one end of said dowel; a dowel keeper carried by said splicing plate in spaced relationship with respect to said vise and a keeper ring for securing the opposite end of said dowel.

4. The splicing apparatus of claim 1 further comprising a splicing plate horizontally provided in said frame and wherein said dowel support means further comprises a vise carried by said splicing plate, a dowel clamp removably clamped in said vise for receiving one end of said dowel; a dowel keeper carried by said splicing plate in spaced relationship with respect to said vise and a keeper ring for securing the opposite end of said dowel.

5. A method for splicing rope segments and covering a splice of said rope segments with a resilient sheet, comprising the steps of providing a splicing apparatus for securing the rope segments in splicing configuration; inserting a rubber sleeve on a dowel; inserting an elongated, cylindrical plastic transfer tube on the dowel to the rubber sleeve; rolling the rubber sleeve in "donut" fashion from the dowel onto the transfer tube; mounting the transfer tube in a rope clamp to receive one of the rope segments; splicing the rope segments; rolling the rubber sleeve from the transfer tube onto the splice to substantially cover the splice; and removing the transfer tube from the spliced rope.

6. The method according to claim 5 further comprising the step of applying glue to the splice before rolling the rubber sleeve over the splice.

* * * * *